US007891839B2

(12) United States Patent
Yang et al.

(10) Patent No.: US 7,891,839 B2
(45) Date of Patent: Feb. 22, 2011

(54) LED LAMP

(75) Inventors: Lin Yang, Shenzhen (CN); Ye-Fei Yu, Shenzhen (CN); Jun Ding, Shenzhen (CN); Jer-Haur Kuo, Taipei Hsien (TW)

(73) Assignees: Fu Zhun Precision Industry (Shen Zhen) Co., Ltd., Shenzhen, Guangdong Province (CN); Foxconn Technology Co., Ltd., Tucheng, Taipei County (TW)

( * ) Notice: Subject to any disclaimer, the term of this patent is extended or adjusted under 35 U.S.C. 154(b) by 212 days.

(21) Appl. No.: 12/248,007

(22) Filed: Oct. 8, 2008

(65) Prior Publication Data

US 2009/0323335 A1 Dec. 31, 2009

(30) Foreign Application Priority Data

Jun. 27, 2008 (CN) ..... 2008 1 0068062

(51) Int. Cl.
*F21S 4/00* (2006.01)

(52) U.S. Cl. ..... 362/249.02; 362/225

(58) Field of Classification Search ..... 362/217.01, 362/217.05, 225, 240, 249.02
See application file for complete search history.

(56) References Cited

U.S. PATENT DOCUMENTS 6,474,852 B1 * 11/2002 Ohkohdo et al. ..... 362/487
6,601,970 B2 * 8/2003 Ueda et al. ..... 362/225
6,871,993 B2 * 3/2005 Hecht ..... 362/555
7,229,198 B2 * 6/2007 Sakai et al. ..... 362/560
7,465,082 B2 * 12/2008 Sakamoto et al. ..... 362/609
7,506,996 B2 * 3/2009 Birman et al. ..... 362/236

FOREIGN PATENT DOCUMENTS

CN 1953177 A 4/2007
CN 101038073 A 9/2007

* cited by examiner

*Primary Examiner*—Stephen F Husar
*Assistant Examiner*—Peggy A. Neils
(74) *Attorney, Agent, or Firm*—Frank R. Niranjan

(57) ABSTRACT

An LED lamp (100) includes a lamp enclosure (10) and two LED modules (30). The lamp enclosure has a concave housing (11). The housing includes an elongated bottom plate (111) and two lateral plates (115) extending upwardly from two opposite lengthwise sides of the bottom plate respectively. An opening (156) is defined at a top side of the lamp enclosure. The LED modules each are mounted at a joint between the bottom plate and a corresponding of the lateral plates in such a manner that at least a portion of lights emitted by the LED modules is firstly directed to and reflected by an internal surface of the bottom plate, and then directed to an outside through the opening.

9 Claims, 4 Drawing Sheets

LED LAMP

BACKGROUND

1. Field of the Invention

The present invention relates to a light emitting diode (LED) lamp, and more particularly to an LED lamp which can provide soft and even light.

2. Description of Related Art

As an energy-efficient light, an LED lamp has a trend of substituting for the fluorescent lamp for a lighting purpose. In order to increase the overall lighting brightness, a plurality of LEDs are often incorporated into a lamp. It is well known that the LEDs are arranged in the form of point light sources in the lamp. Thus, uncomfortable glare is caused by the LED light sources, which is harmful to a user's eyes.

What is needed, therefore, is an LED lamp which can provide soft and even light.

SUMMARY

An LED lamp includes a lamp enclosure and two LED modules. The lamp enclosure has a concave housing. The housing includes an elongated bottom plate and two lateral plates extending upwardly and slantwise from two opposite lengthwise sides of the bottom plate, respectively, in directions away from each other. An opening is defined at a top side of the lamp enclosure. The LED modules each are mounted at a joint between the bottom plate and a corresponding one of the lateral plates in such a manner that at least a portion of lights emitted by the LED modules is firstly directed to and reflected by an internal surface of the bottom plate, and then directed to an outside through the opening.

Other advantages and novel features of the present invention will become more apparent from the following detailed description when taken in conjunction with the accompanying drawings.

BRIEF DESCRIPTION OF THE DRAWINGS

Many aspects of the present LED lamp can be better understood with reference to the following drawings. The components in the drawings are not necessarily drawn to scale, the emphasis instead being placed upon clearly illustrating the principles of the present LED lamp. Moreover, in the drawings, like reference numerals designate corresponding parts throughout the several views.

DETAILED DESCRIPTION

Figure 1:
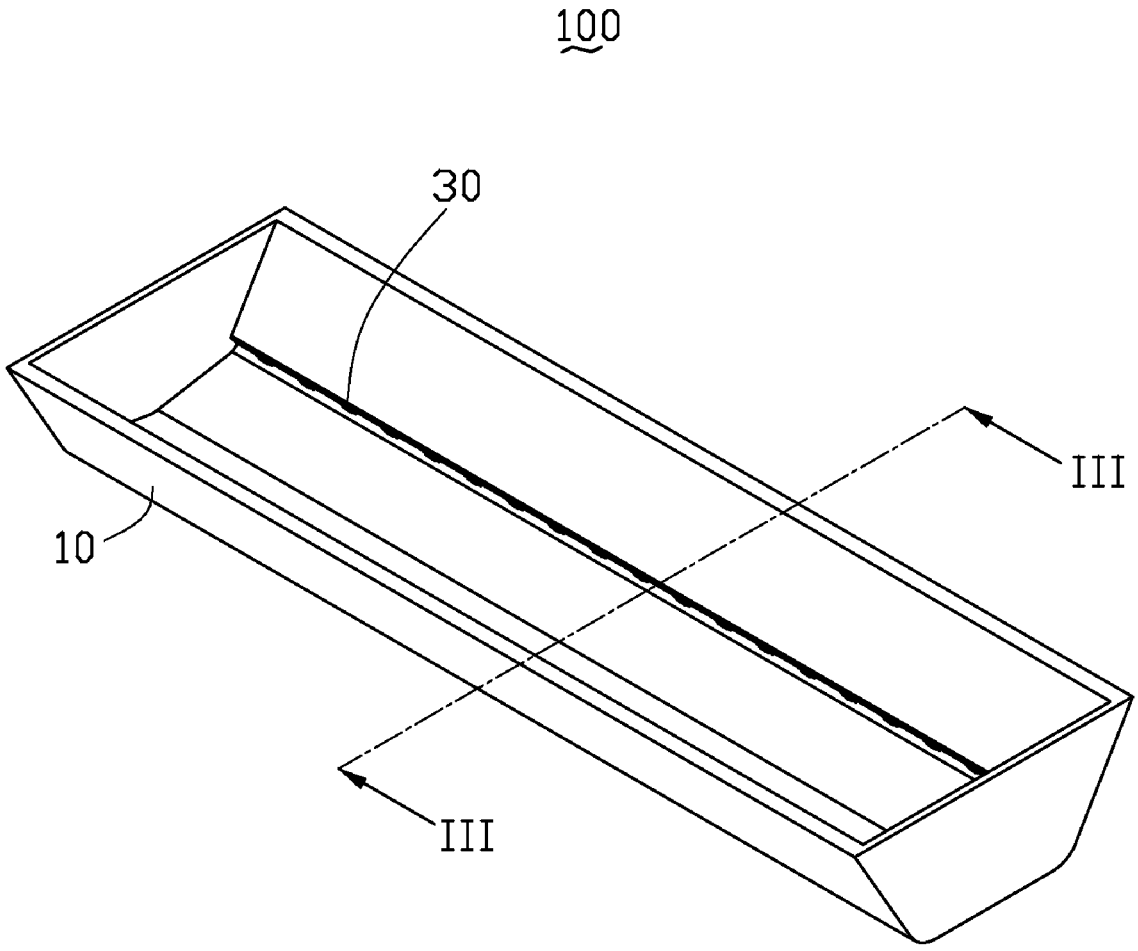
FIG. 1 is an assembled, isometric view of an LED lamp in accordance with an embodiment of the present invention.

Referring to FIG. 1, an LED lamp 100 in accordance with an embodiment of the present invention is shown. The LED lamp 100 comprises a lamp enclosure 10 and two LED modules 30, wherein only one LED module 30 is visible in FIG. 1. The lamp enclosure 10 has a concave configuration. The LED modules 30 are mounted inside the lamp enclosure 10.

Figure 2:
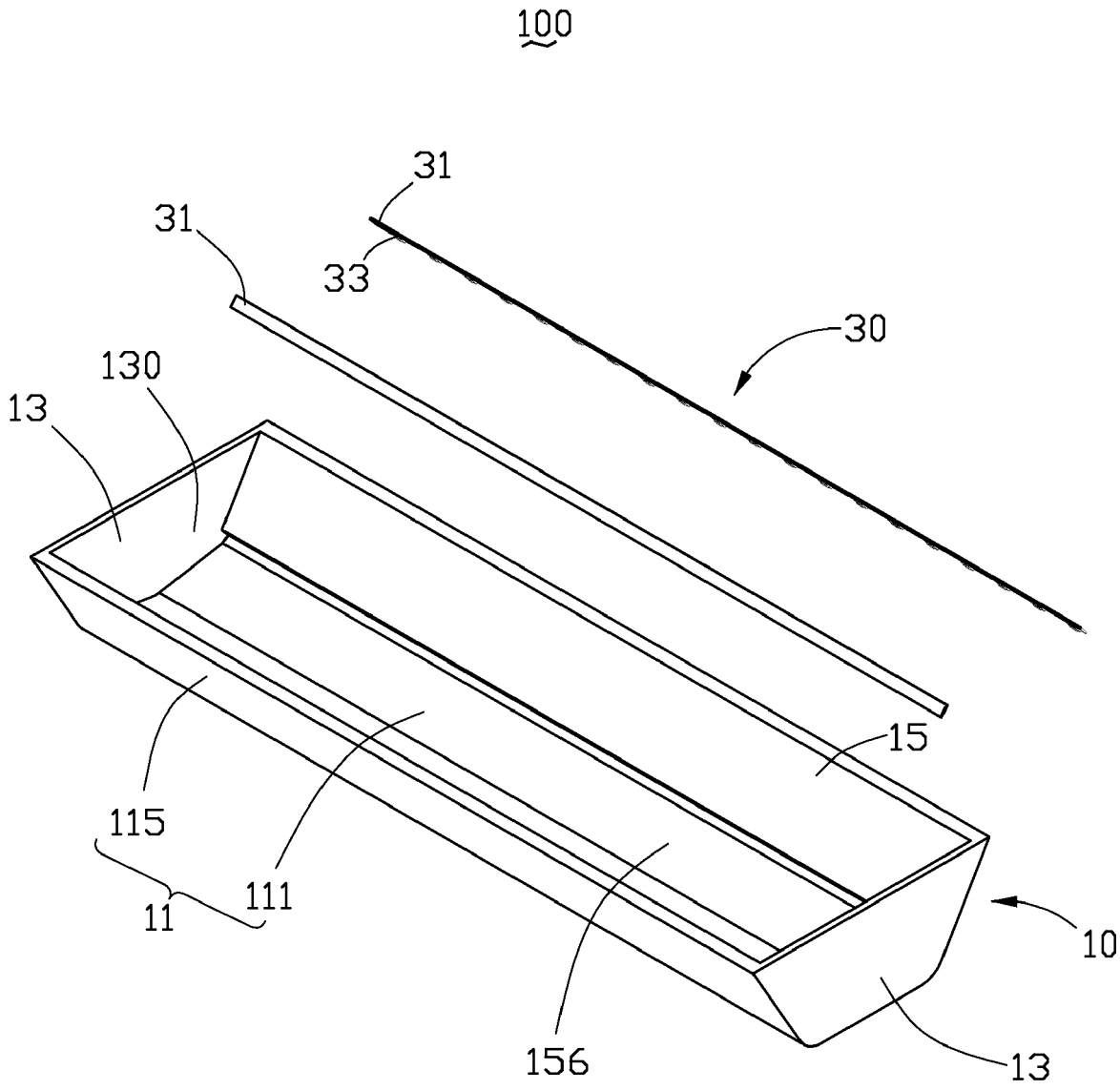
FIG. 2 is an exploded, isometric view of the LED lamp shown in FIG. 1.
Figure 3:
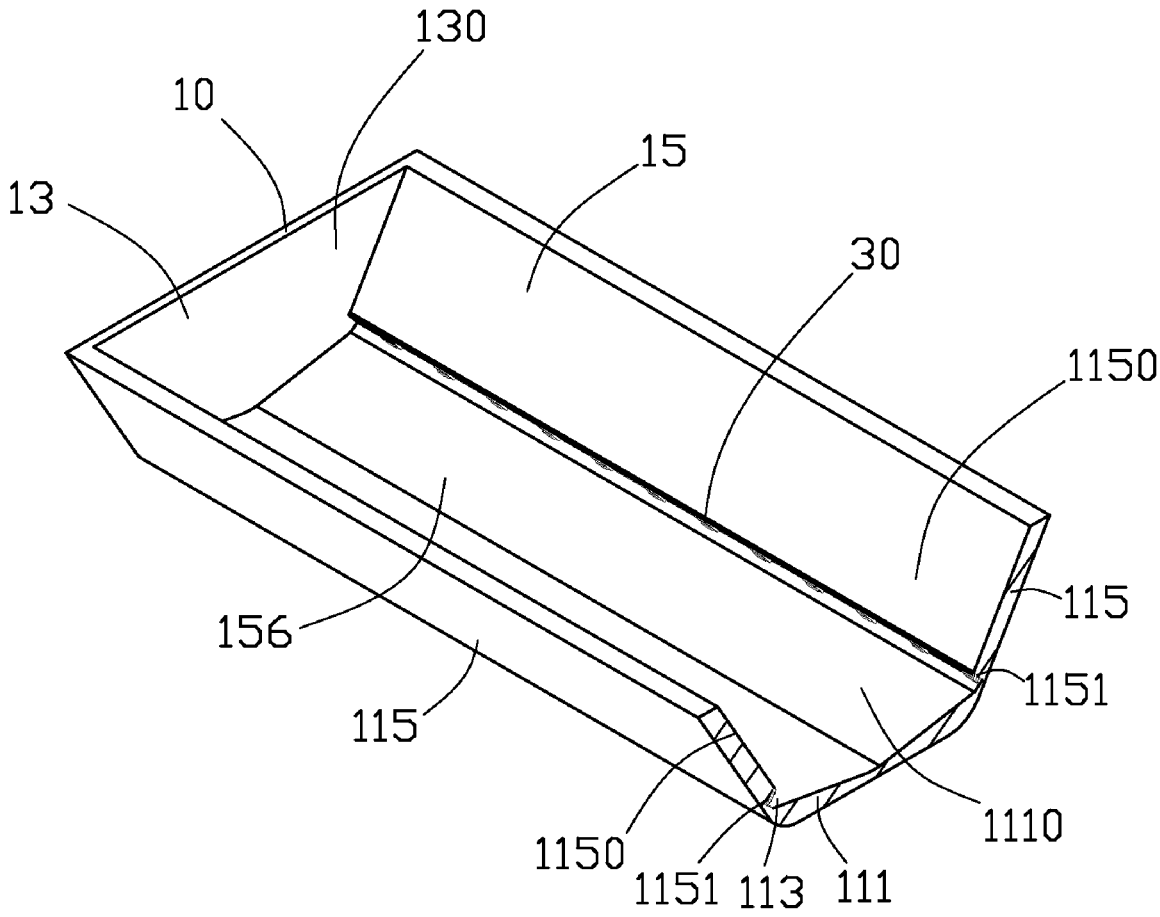
FIG. 3 is an isometric, cross-sectional view of the LED lamp shown in FIG. 1, taken along line III-III thereof.

Referring to FIGS. 2 and 3, the lamp enclosure 10 includes a concave housing 11 and two side plates 13 integrally connected to two opposite ends of the housing 11, respectively.

The housing 11 has an elongated configuration, and has a generally U-shaped cross section. The side plates 13 are trapeziform, flat plates and are located at two longitudinal ends of the housing 11, respectively. The side plates 13 and the housing 11 cooperatively form a depression 15.

The housing 11 includes a bottom plate 111 and two lateral plates 115. The bottom plate 111 has an elongated configuration and is configured to form a base of the lamp enclosure 10. The bottom plate 111 has an elongated internal surface 1110 on a top thereof. The internal surface 1110 has a V-shaped profile. The internal surface 1110 is depressed traverse from two lengthwise sides to a centre of the bottom plate 111. The lateral plates 115 are elongated, flat plates, and extend upwardly and slantingly outwardly from the lengthwise sides of the bottom plate 111, respectively. The lateral plates 115 and the side plates 13 are configured to form a sidewall of the lamp enclosure 10.

Figure 4:
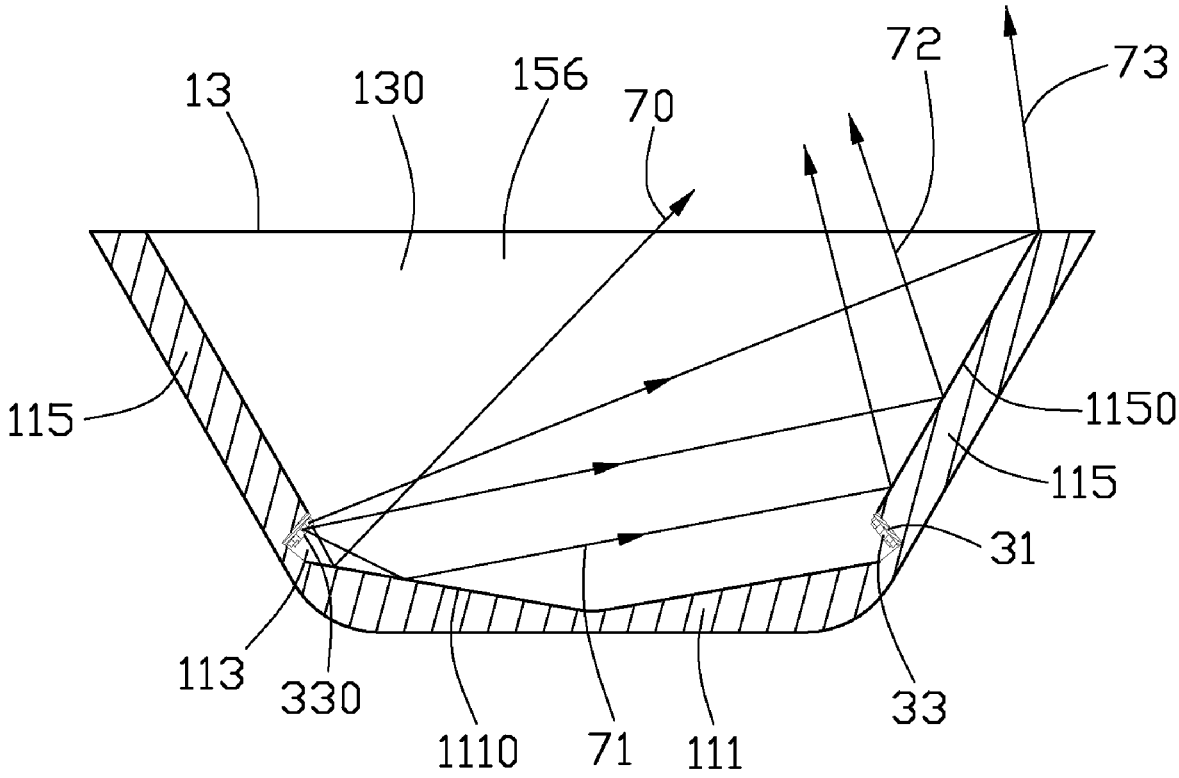
FIG. 4 is an end view of the LED lamp shown in FIG. 3, with arrows indicating light transmitting paths.

Also referring to FIG. 4, an elongated groove 113 is defined at a joint at which the bottom plate 111 and each of the lateral plates 115 are joined. The grooves 113 extend along a direction parallel to the bottom plate 111 from one side plate 13 to the other side plate 13. The lateral plates 115 each have an internal reflective surface 1150 and an internal fixing surface 1151. The reflective surface 1150 is located above the groove 113 at a lateral side of the lateral plate 115 and faces towards the depression 15. The fixing surface 1151 is located at a bottom side of the lateral plate 115 and faces towards the groove 113. The fixing surface 1151 is used to mount the LED module 30 thereon.

The side plates 13 each have an internal reflective surface 130 which faces towards the depression 15.

The lamp enclosure 10 defines an opening 156 in a top side thereof. The opening 156 communicates the depression 15 with ambient air over the lamp enclosure 10. The depression 15 has a width which increases gradually along a bottom-to-top direction of the housing 11. A high reflective material is painted on the internal reflective surfaces 1110, 130 and the reflective surface 1150.

The LED modules 30 each include an elongated substrate 31 and a plurality of LEDs 33 spaced from each other and equidistantly mounted on the substrate 31. Generally, the substrate 31 is a printed circuit board. The substrate 31 has an elongated configuration and extends along a direction parallel to the bottom plate 111. The LED modules 30 are attached respectively to the fixing surfaces 1151 of the lateral plates 115 and face towards the grooves 113 and the internal surface 1110 of the bottom plate 111.

Referring to FIG. 4, each of the LEDs 33 has a light emitting surface 330. The light emitting surface 330 is oriented towards the corresponding groove 113 and the internal surface 1110 of the bottom plate 111. A portion of light 70 emitted by the light emitting surface 330 is firstly directed to the internal surface 1110, and then reflected to the opening 156. Another portion of light 71 emitted by the light emitting surface 330 is firstly directed to the internal surface 1110, then reflected to the reflective surface 1150 of the lateral plate 115, and at last reflected to the opening 156. Further another portion of light 72 emitted by the light emitting surface 330 is firstly directed to the reflective surface 1150, and then reflected to the opening 156. There is still another portion of light directed to the internal surface 130 of the side plate 13, and then reflected to the opening 156. The LEDs 33 are oriented towards a bottom of the lamp enclosure 10 in such a manner that all lights emitted by the light emitting surface 330 are firstly directed to and reflected by the internal reflective surfaces of the lamp enclosure 10, and then directed to outside environment. In this embodiment, an outmost portion of light 73, which is emitted from an outmost periphery of the light emitting surface 330, is directed to intersect with a top edge of the housing 11.

In a word, the LED lamp 100 is arranged in such a manner that the LEDs 33 do not directly emit their lights to the opening 156. Thus, users can not see the lights of the LEDs 33 directly so that uncomfortable glare is reduced. Accordingly, the LED lamp 100 can provide soft and even light for users.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a lamp enclosure comprising a concave configuration, and at least one LED module, wherein the lamp enclosure comprises a bottom plate and at least one lateral plate extending upwardly from the bottom plate, an opening is defined at a top side of the lamp enclosure, the at least one LED module is mounted on the lateral plate and faces towards the bottom plate in such a manner that all lights emitted by the at least one LED module are firstly directed to and reflected by an internal surface of the lamp enclosure, and then directed to an outside through the opening;

wherein at least one groove is defined at a joint at which the bottom plate and the at least one lateral plate are joined, and the at least one LED module is received in the at least one groove and faces towards the bottom plate of the lamp enclosure;

wherein the at least one lateral plate includes two lateral plates extending from two opposite lengthwise sides of the bottom plate, the at least one groove includes two grooves, each of the grooves is defined at a joint at which the bottom plate and each of the lateral plates are joined, and the grooves extend along a direction parallel to an extension direction of the housing; and wherein the bottom plate comprises an elongated internal surface with a substantially V-shaped profile, and the internal surface of the bottom plate is depressed from the two opposite lengthwise sides to a center of the bottom plate.

2. The LED lamp as claimed in claim 1, wherein the lamp enclosure includes a concave housing, the housing has an elongated configuration and a substantially U-shaped cross section, and the housing is comprised of the bottom plate and the two lateral plates.

3. The LED lamp as claimed in claim 1, wherein the at least one LED module includes two LED modules, each of the LED modules includes an elongated substrate and a plurality of LEDs spaced from each other and equidistantly mounted on the substrate, and the LED modules are respectively mounted in the grooves.

4. The LED lamp as claimed in claim 3, wherein each of the LEDs has a light emitting surface oriented towards a corresponding groove and towards the bottom plate.

5. The LED lamp as claimed in claim 1, wherein each of the lateral plates includes an internal reflective surface and an internal fixing surface, and the reflective surface is located at a lateral side of the lateral plate, and the fixing surface is located at a bottom side of the lateral plate and faces towards a corresponding groove, and wherein the at least one LED module is mounted on the fixing surface.

6. The LED lamp as claimed in claim 2, wherein the lamp enclosure further includes two side plates located at two longitudinal ends of the housing, the side plates and the housing cooperatively form a depression, and the depression has a width which increases along a bottom-to-top direction of the housing.

7. An LED lamp comprising:

a lamp enclosure comprising a concave configuration, and at least one LED module, wherein an opening is defined at a top side of the lamp enclosure, the at least one LED module is mounted adjacent to a bottom side of the lamp enclosure and oriented towards the bottom side in such a manner that all lights emitted by the at least one LED module are firstly directed to and reflected by an internal surface of the lamp enclosure, and then directed to an outside through the opening;

wherein the lamp enclosure includes a concave housing, the housing including an elongated bottom plate and two lateral plates extending upwardly from two opposite lengthwise sides of the bottom plate respectively, and the at least one LED module includes two LED modules each mounted at a joint between the bottom plate and a corresponding one of the lateral plates; and wherein the bottom plate comprises an elongated internal surface with a substantially V-shaped profile, and the internal surface of the bottom plate is depressed from the two opposite lengthwise sides to a center of the bottom plate.

8. The LED lamp as claimed in claim 7, wherein two elongated grooves each are formed at a joint at which the bottom plate and each of the lateral plates are joined.

9. The LED lamp as claimed in claim 8, wherein the LED modules are received in the grooves in such a manner that light emitted by the LED modules is firstly emitted to internal surfaces of the bottom plate or the lateral plates.

* * * * *